US005626656A

United States Patent [19]

Kondo et al.

[11] Patent Number: 5,626,656

[45] Date of Patent: May 6, 1997

[54] STOCK SOLUTION OF RELEASE AGENT FOR GREEN SAND MOLD FORMING

[75] Inventors: Kazumitsu Kondo, Inuyama; Keiichi Ito, Kasugai, both of Japan

[73] Assignee: Tetra Co., Ltd., Kasugai, Japan

[21] Appl. No.: 653,920

[22] Filed: May 22, 1996

Related U.S. Application Data

[63] Continuation of Ser. No. 284,433, filed as PCT/93/01892 Dec. 27, 1993 published as WO 94/14556 Jul. 7, 1994, abandoned.

[30] Foreign Application Priority Data

Dec. 28, 1992 [JP] Japan ..... 4-348185
Apr. 12, 1993 [JP] Japan ..... 5-084715

[51] Int. Cl.[6] ..... B28B 7/36; C09D 5/00

[52] U.S. Cl. ..... 106/38.24; 106/2; 106/38.22; 106/38.7; 106/243; 106/285; 106/287.26; 106/287.3; 508/259; 508/262; 508/268; 508/283; 508/527

[58] Field of Search ..... 106/2, 38.22, 38.24, 106/38.7, 243, 285, 287.3, 287.26; 252/49.5

[56] References Cited

U.S. PATENT DOCUMENTS

| | | | |
|---|---|---|---|
| 2,932,576 | 4/1960 | Vierk et al. | 106/38.24 |
| 3,495,962 | 2/1970 | Norton et al. | 106/38.24 |
| 3,839,234 | 10/1974 | Roscoe | 252/544 |
| 3,888,690 | 6/1975 | Geiser | 106/38.22 |
| 4,038,088 | 7/1977 | White et al. | 106/38.24 |
| 4,676,997 | 6/1987 | LaFay et al. | 106/38.22 |
| 5,133,804 | 7/1992 | Culpon, Jr. | 106/38.22 |
| 5,164,143 | 11/1992 | Meyer et al. | 106/38.24 |
| 5,308,393 | 5/1994 | Hättich et al. | 106/38.22 |
| 5,378,270 | 1/1995 | Takashima | 106/38.22 |

FOREIGN PATENT DOCUMENTS

| | | | |
|---|---|---|---|
| 1588837 | 4/1970 | France | 106/38.24 |
| 1201229 | 9/1965 | Germany | 106/38.24 |
| 154168 | 3/1982 | Germany | 106/38.22 |
| 52-053916 | 4/1977 | Japan | 106/38.22 |
| 63-29625 | 6/1988 | Japan . | |
| 2-235544 | 9/1990 | Japan . | |
| 4-265706 | 9/1992 | Japan | 106/38.24 |
| 4305330 | 10/1992 | Japan . | |
| 4-305330 | 10/1992 | Japan | 106/38.22 |
| 4-332605 | 11/1992 | Japan | 106/38.24 |
| 5-57393 | 3/1993 | Japan | 106/38.24 |
| 655544 | 4/1979 | U.S.S.R. | 106/38.24 |
| 697554 | 11/1979 | U.S.S.R. | 106/38.24 |
| 715335 | 2/1980 | U.S.S.R. | 106/38.22 |
| 718273 | 2/1980 | U.S.S.R. | 106/38.22 |
| 1551548 | 3/1990 | U.S.S.R. | 106/38.22 |
| WO85/05066 | 11/1985 | WIPO . | |

*Primary Examiner*—Anthony Green
*Attorney, Agent, or Firm*—Armstrong, Westerman, Hattori, McLeland & Naughton

[57] ABSTRACT

A release agent for green sand mold forming contains a hydrocarbon oil as the main lubrication component. The release agent contains a surface active agent as a dispersant and an anion surface active agent and/or a strong basic amine as a wettability improving agent as essential components besides the hydrocarbon oil. The release agent is used in a form of oil-in-water type emulsion by diluting it with water. Since it is possible to dilute the release agent with water, the release agent occupies less capacity during storage and transportation, and since the release agent can increase the water to the hydrocarbon oil ratio of the composition at application, it contributes to improvements in resource saving and safety against fire.

6 Claims, 1 Drawing Sheet

STOCK SOLUTION OF RELEASE AGENT FOR GREEN SAND MOLD FORMING

This application is a continuation of application Ser. No. 08/284,433, filed as PCT/JP93/01892, Dec. 27, 1993 published as WO94/14556 Jul. 7, 1994, now abandoned.

BACKGROUND OF THE INVENTION

This invention relates to a stock solution of a release agent for green sand mold forming containing a hydrocarbon oil as the main component for lubrication and to a release agent for green sand mold forming.

A green sand mold which is the most based type of mold stays in the main stream of molds because its advantages are a good forming productivity, inexpensive materials for mold, and applicability for repeated use compared with other molds such as thermosetting mold, self-hardening mold, and gas-hardening mold.

The applicant of this invention provided a release agent for green sand mold forming which is an water-in-oil (W/O) emulsion, or a system of oil phase of hydrocarbon containing dispersed water phase, (refer to the Examined Japanese Patent Publication No. 63-29625).

This type of release agent has, however, the following disadvantages.

(1) Since the emulsion system used is the water-in-oil (W/O) type, the system can not diluted with water. Accordingly, the system needs to be prepared from the production stage to have a composition of application. This requirement causes problems with regard to shipment and storage.

(2) The water content is limited to approximately 60% at the highest from the standpoint of stability of the prepared liquid and releasability of the product. This percentage of water content is not sufficiently high in terms of resource saving and safety against fire.

To cope with these concerns, the release agent may be prepared in the oil-in-water (O/W) emulsion. However, a uniform lubricant film is considered difficult to form on the surface of a mold after being used for forming. The reason of the difficulty is that, since the main component for lubrication is a hydrocarbon oil, the surface of a mold once used for forming by applying a releasing agent, particularly a metallic mold, leaves the oil component on the surface thereof, which remained oil repels a release agent of water-based O/W emulsion when it is applied onto the surface of the metallic mold.

An object of this invention is to provide a stock solution of release agent for green sand mold forming, which stock solution is applicable in a form of O/W emulsion and is diluted at the point of application.

Another object of this invention is to provide a stock solution of a release agent for green sand mold forming, which stock solution is applicable in a form of an aqueous solution and does not require the use of hydrocarbon oil.

DISCLOSURE OF THE INVENTION (1) A preferable mode of the stock solution of a release agent for green sand mold forming of this invention is a stock solution of a release agent for green sand mold forming containing a hydrocarbon oil as the main component for lubrication, wherein the stock solution contains 1) a surface active agent as the dispersant and 2) an anionic surface active agent and/or strong basic amine as the wettability improving agent as essential components besides the hydrocarbon oil, and wherein the stock solution is used upon diluting it with water to prepare an oil-in-water emulsion. That type of composition achieves the first object of this invention and has the advantages and effect described below.

As clarified in the Examples given later, an improvement of wettability to the mold under an application of the stock solution of this invention as the release agent prevents the applied release agent from being repelled when it is applied onto the surface of mold even when an oil component is left on the surface of the mold (particularly a metallic mold) which was used for forming in the application of a release agent. Accordingly, a uniform lubricant film is formed on the surface of the mold, and it is possible to apply the release agent in the form of O/W emulsion.

As a result, the stock solution of the release agent of this invention can be diluted with water, which means that the stock solution occupies a smaller capacity during storage and transportation and that the stock solution is easily handled during storage and transportation.

In addition, it is possible to increase, to 60% or more, the ratio of water to hydrocarbon oil in the stock solution of the release agent of this invention. This contributes to improvements in resource saving and safety against fire.

(2) Another preferable mode of this invention is a stock solution of a release agent for green sand mold forming containing a strong basic amine and a higher fatty acid and/or ethylene glycol group as the essential components, wherein the stock solution is diluted with water to an adequate viscosity to use in the form of an aqueous solution. This type of composition achieves the second object of this invention and has the advantages and effect described below.

As clarified in the Examples given later, even when an oil component is left on the surface of a mold (particularly a metallic mold) which was used for forming upon application of a release agent, the release agent as successively applied onto the mold surface is not repelled from the surface. Accordingly, a uniform lubricant film is formed on the surface of the mold, and the release agent is capable of being applied in the form of an aqueous solution. That is presumably caused by improved wettability of the solution of this invention against the mold surface when the solution is used as a release agent.

Therefore, similar to the former case, since it is possible to dilute with water the stock solution of this invention which is used for lubrication and which has the composition described above, the stock solution has the advantages that it requires less space for storage and transportation and is easy to handle for storage and transportation purposes. Furthermore, since the solution of this invention does not contain any hydrocarbon oil at the point of application, the solution of this invention contributes to improvements in resource saving and safety against fire.

THE MOST PREFERABLE MODE OF THE INVENTION

Figure 1:
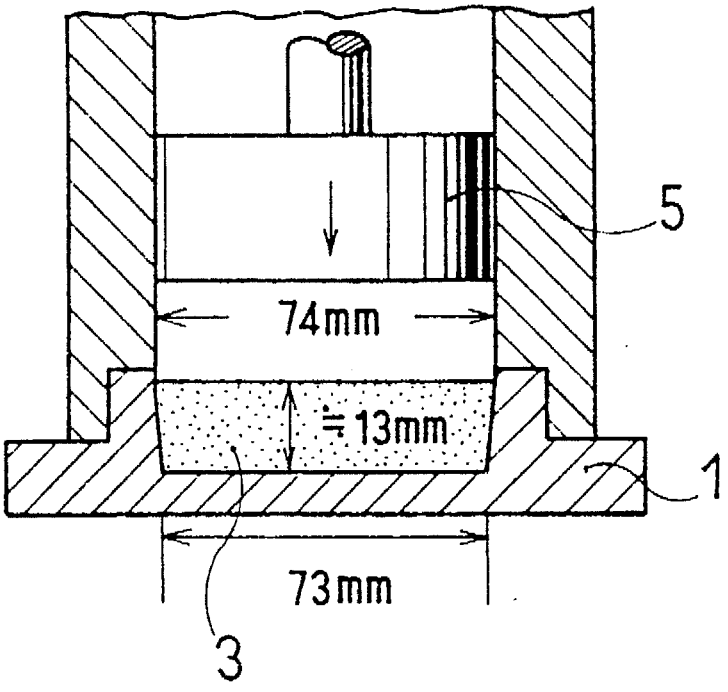
FIG. 1 is a schematic drawing illustrating a squeeze forming process which is employed to test the releasability.

In the following description, the unit of mixing is weight based unless otherwise specified. Thus, "parts" means parts by weight.

A. Stock solution of a release agent for the first invention (a) The stock solution of a release agent for green sand mold forming of this invention has a basic requirement of containing a hydrocarbon oil as the main component for lubrication. From the point of view of handling, it is preferable that the hydrocarbon oil be one in the petroleum group having a flash point of 55° C. or above. Examples of that type of hydrocarbon oil are lubricant oils such as gear oil, machine oil, bearing oil, or turbine oil, and kerosene and light oil. These oils may be used separately or as a mixture of some of them.

(b) The stock solution of a release agent for green sand mold forming of this invention has a specific requirement of containing a surface active agent as the dispersant and an anionic surface-active agent and/or strong basic amine as the wettability improving agent as essential components besides the hydrocarbon oil.

(1) The surface-active agent as the above-described dispersant may be nonionic, anionic, cationic or amphoteric. However, from the viewpoint of stability of oil-in-water (O/W) emulsion during use the nonionics listed below are preferable.

(i) Nonionic surface-active agent: alkylpolyoxyethylene ether, alkylcarbonyl polyoxyethylene, p-alkylphenyl polyoxyethylene ether, N,N-di(polyoxyethylene)alkane amide, fatty acid polyhydric alcohol ester, fatty acid polyhydric alcohol polyoxyethylene, fatty acid saccharose ester, castor oil ethylene oxide additive.

The composition ratio of the surface-active agent used as the dispersant is in a range of from 1 to 50 parts (more preferably in a range of from 2 to 30 parts) to 100 parts of the hydrocarbon oil. An amount of less than 1 part is hardly sufficient to prepare an O/W emulsion, and an amount of above 50 parts does not increase the effect corresponding to the added amount.

(2) The anionic surface-active agent and the strong basic amine used as the wettability improving agent described above may be the following.

(i) Anionic surface-active agent: higher fatty acid alkali salt (soap), sodium alkylsulfate, sodium secondary alkylsulfate, sodium alkylbenzene sulfonate, sodium alpha-olefin sulfonate, sodium N-acylamino acid, sodium alkylnaphthalene, sodium N-(2-sulfo)ethyl-N-methyl alkane amide, 2-sulfone diarylamide succinate.

(ii) Strong basic amine: morpholine, piperidine, piperazine, pyrrolidine, pyrrole, imidazole, diethylamine, benzylamine, etc. The composition ratio of the anion surfactant and/or strong basic amine used as the wettability improving agent is in a range of from 1 to 100 parts (more preferably in a range of from 2 to 80 parts) to 100 parts of the hydrocarbon oil. An amount of less than 1 part is hardly sufficient to improve the wettability of release agent against a metallic mold, and the ratio of above 100 parts does not increase the effect corresponding to the added amount.

When an anionic surface-active agent is used as the wettability improving agent, the sum of the anionic surface active agent as the wettability improving agent and the surface-active agent as the dispersant is in a range of from 2 to 80 parts. When a nonionic surface active agent is used as the above-described surface-active agent as an additional component, the ratio (anionic)/(nonionic) is in a range of from 1/9 to 9/1 (more preferably in a range of from 4/6 to 8/2).

(3) It is more preferable to add a higher fatty acid and its derivative as an assistant to the release agent listed below, or to add a small amount of water as the emulsion nuclei-forming agent.

(i) Examples of the higher fatty acid are stearic acid, palmitic acid, oleic acid, etc. having 8 to 20 carbon atoms. Derivatives may be the ester amide derivatives of these.

The mixing ratio of the assistant to the release agent is in a range of from 2 to 40 parts to 100 parts of hydrocarbon oil.

(2) The addition of water is a common practice used to enhance natural emulsification. By adding water to the system, the O/W emulsion nuclei are formed in the release agent composition in advance, which facilitates the emulsification in a succeeding step of water dilution. The amount of water added to the system is in a range of from 1/10 to 1/5 to the total amount of hydrocarbon oil and surface-active agent.

B. Stock solution of a release agent for green sand mold forming for the second invention (1) The stock solution of a release agent for green sand mold forming of this invention contains a strong basic amine and a higher fatty acid and/or ethylene glycol group as the essential components.

(i) The strong basic amine may be the ones listed in the description of the first invention.

(ii) Examples of the higher fatty acid are oleic acid, linoleic acid, lauric acid, palmitic acid, stearic acid, etc. having 8 to 20 carbon atoms. Derivatives may be ester amide derivative of these.

The mixing ratio of the higher fatty acid to the basic amine of 100 parts is in a range of from 10 to 50 parts, and more preferably in a range of from 20 to 40 parts. The higher fatty acid acts as a barrier agent which prevents the contact between the sand and the mold.

(iii) Examples of the ethylene glycol group are ethylene glycol, diethylene glycol, and triethylene glycol.

The mixing ratio of the ethylene glycol group to the basic amine of 100 parts is in a range of from 20 to 80 parts, and more preferably in a range of from 30 to 60 parts. The ethylene glycol group provides an effect of lubrication when it is used as aqueous solution.

(2) The stock solution of a release agent preferably contains a surface-active agent at 30% or less of the quantity of higher fatty acid, more preferably at 15% or less, to assist the dispersibility of the higher fatty acid, though the addition of the surface-active agent for this purpose is not essential. The adding surface-active agent may be nonionic, anionic, cationic or amphoteric. Particularly, a surface-active agent of the anionic group is most preferable in view of improvements in the wettability of an aqueous solution.

(i) Anionic surface-active agent may be those listed in the example of the first invention.

(3) Apart from the above-described essential components, when the stock solution is prepared in an aqueous solution, it is preferable to add water to the system as the dissolution-enhancing agent, generally, at a rate of half or less than half of the quantity of the essential components to improve the safety of the stock solution against fire.

C. The above-described components are mixed at a time, and they are agitated in a mixer to prepare the stock solution of the release agent. The storage and shipment of the stock solution are carried out at the as-mixed composition. When the stock solution is applied to a mold surface, the stock solution is diluted with water to a viscosity (normally to a range of from 1 to 30 cp) that is adequate for use.

The capability of the stock solution of the release agent of this invention to be diluted with water allows it to occupy less volume during storage and transportation and allows for easy handling of the solution during storage and transportation.

In addition, it is possible to increase, to 60% or more, the ratio of water to hydrocarbon oil in the stock solution of the release agent of this invention at the point of application. Furthermore, the stock solution of the release agent of this invention does not contain any hydrocarbon oil so that the solution contributes to improvements in resource saving and safety against fire.

D. A release agent which was prepared by diluting a stock solution of a release agent according to the procedure described above is applied to a model or the like for the forming of a green mold. The model to which it can be applied is not limited to metallic model (cast iron, copper alloy, aluminum alloy, steel, etc.) and is the one made of arbitrary material such as plastic (epoxy resin, etc.), gypsum, and wood. The method used for applying it is usually that of spraying, while, however, brushing, dipping, and other methods are also applicable.

The normal volume of at which the release agent is applied is in the range of from 20 to 400 ml/m$^2$.

The forming is successively conducted on the prepared model using various forming methods such as squeezing, jolting, blowing, or by using sand slinger.

EMBODIMENT

The following examples and comparative examples serve to confirm the effect of the invention.

A. Preparation of the release agent (1) Group 1 for the first invention

In Examples 1 through 10 and Comparative Example 1, each of the mixtures having the composition listed in Table 1 was manually agitated in a beaker using a glass rod to prepare the stock solution of the release agent.

Then, the dilution water was added to each stock solution of the release agent to make the amount of the composition as listed in Table 1 under manual agitation with a glass rod to prepare the release agent.

The Comparative Example 2 was a commercial release agent for a shell mold, which agent had the composition given below.

| Composition | |
|---|---|
| dimethylsilicon 500 | 30 parts |
| secondary straight-chained alcohol ethoxylate (HLB 13.5) | 8 parts |
| sodium dodecylbenzene sulfonate (50% conc.) | 1 part |
| water | 61 parts |

(2) Group 2 for the second invention

In Examples A through H and Comparative Examples 3 and 4, each of the mixtures having the composition listed in Table 2 was manually agitated in a beaker using a glass rod to prepare the stock solution of the release agent.

Then, the dilution water was added to each stock solution of the release agent to make the amount of the composition as listed in Table 2 under manual agitation with a glass rod to prepare the release agent.

B. Test method

Referring to FIG. 1, a metallic model 1 made of cast iron being coated with chromium and having the cross section shown in the figure was employed for each test. A prepared release agent was sprayed onto the inside surface of the model 1 from a distance of 40 cm (for every forming cycle). The spray unit used was one manufactured by Meiji Sha Co. Ltd.; and the operating conditions were: a nozzle opening of 0.13 mm, an air pressure of 392 kPa, and an application time of 1 sec.

Immediately after the spraying, a material for green sand mold 3 containing 3.5% of water was charged into the metallic model 1, and squeeze-forming was conducted using a squeeze head 5. The forming conditions were: a green sand charge of 80 g, a squeeze pressure of 980 kPa, and a forming height of approximately 13 mm. The following items were tested for each of the prepared form samples.

(1) Releasability (degree of stain)

After the completion of the forming, the metallic model was reversed and was dropped down vertically from a height of 10 cm above the table top to separate the formed green mold from the metallic model 1. The degree of stain of the green sand on the metallic model 1 was visually evaluated. Then, the same metallic model 1 was used for repeated formings, and the sustained releasability (the releasability after the sixth forming) was evaluated along with that after the first forming.

The judging criteria applied in the evaluation were the following.

⊙: very good, ○: good, Δ: some sand particles remained, X: stained with sand (2) Liquid stability After preparing a release agent for application, it was allowed to stand in a room for 24 hours, and the state of the liquid was observed for the purpose of evaluation.

The applied criteria for evaluation were the following.

⊙: emulsion did not show any separation for 24 hours and maintained a good dispersion.

○: no separation was observed after 24 hours.

Δ: separation was observed after 24 hours.

C. Test result and evaluation

Tables 3 and 4 show the test results of groups 1 and 2, respectively.

GROUP 1

(1) Regarding the releasability, each of the Examples in group 1 was superior to the Comparative Example 1 (not containing the wettability improving agent) and to the Comparative Example 2 (commercial release agent for a shell mold), and showed a good sustained releasability as well as initial releasability.

The release agent of Example 1 was applied to a commercial casting plant machine for green sand mold forming. The forming of a differential case and other shapes was successfully performed for 30 to 40 shots without the occurrence of defects such as a collapsed mold.

(2) Also in terms of liquid stability, each of the Examples in group 1 showed better performance than Comparative Example 1 as a whole.

GROUP 2

(1) As for the releasability, each of the Examples in group 2 was superior to Comparative Examples 2 and 3, and showed a good sustained releasability as well as initial releasability.

(2) Also in terms of liquid stability, each of the Examples in group 2 showed performed similarly to Comparative Examples 3 and 4.

TABLE 1

| | EXAMPLE | | | | | | | | | | COMPARATIVE EXAMPLE |
|---|---|---|---|---|---|---|---|---|---|---|---|
| | 1 | 2 | 3 | 4 | 5 | 6 | 7 | 8 | 9 | 10 | 1 |
| Assistant to release agent | | | | | | | | | | | |
| Oleic acid | 1 | 1 | 1 | 0.67 | 1 | 1 | | 1 | 1 | 1 | 1 |
| Nonionic surface-active agent | | | | | | | | | | | |
| Sorbitan mono-oleate | 0.5 | 0.5 | 0.5 | 0.33 | 0.5 | 0.5 | 0.5 | 0.5 | 0.5 | 0.5 | 0.5 |
| Polyoxyethylene nonylphenol ether: 10 mol | 0.5 | 0.5 | 0.5 | 0.33 | 0.5 | 0.5 | 0.5 | 0.5 | 0.5 | 0.5 | 0.5 |
| Wettability improving agent | | | | | | | | | | | |
| Morpholine | 1.5 | 1.5 | 1.5 | 1.0 | | 1 | 1.5 | | | | |
| Piperidine | | | | | | | | 1.5 | | | |
| Pyrrolidine | | | | | | | | | 1.5 | | |
| Benzylamine | | | | | | | | | | 1.5 | |
| Sodium dodecylbenzene sulfonate: 60% | 1.5 | 1.5 | 1.5 | 1.0 | 2 | | 1.5 | | | | |
| Emulsion nuclei-forming agent | | | | | | | | | | | |
| Water | 5 | 5 | 5 | 3.33 | 5 | 5 | 5 | 5 | 5 | 5 | |
| Hydrocarbon oil | | | | | | | | | | | |
| Spindle oil # 60 | | | 5 | | | | | 5 | 5 | 5 | |
| Fog solvent | 25 | 5 | 15 | 13.3 | 26 | 27 | 25 | 2.15 | 2.15 | 2.15 | 28 |
| Dilution water | 65 | 85 | 70 | 80 | 65 | 65 | 65 | 65 | 65 | 65 | 70 |

TABLE 2

| | EXAMPLE | | | | | | | | Comparative EXAMPLE | |
|---|---|---|---|---|---|---|---|---|---|---|
| | A | B | C | D | E | F | G | H | 3 | 4 |
| Oleic acid | 2 | 2 | 2 | 2 | 2 | 2 | 2 | | | 1.8 |
| Piperidine | | | 6.8 | | | | | | | |
| Pyrrolidine | | | | 6.8 | | | | | | |
| Morpholine | 6.8 | 8 | | | | | 8 | 10 | | |
| Benzylamine | | | | | 8 | 6.8 | | | | |
| Sodium doecylbenzene sulfonate: 60% | 0.2 | | 0.2 | 0.2 | | 0.2 | | | | |
| Ethylene glycol | | | | | | | 3 | 5 | | |
| Sodium nitrite | | | | | | | | | 20 | |
| Sodium metasilicate-9-hydrate | | | | | | | | | | 4.8 |
| Water | 5 | | 5 | 5 | | 5 | | | | 10 |
| Water (for dilution) | 86 | 90 | 86 | 86 | 90 | 85 | 87 | 85 | 80 | 83.4 |

TABLE 3

| | EXAMPLE | | | | | | | | | | COMPARATIVE EXAMPLE | |
|---|---|---|---|---|---|---|---|---|---|---|---|---|
| | 1 | 2 | 3 | 4 | 5 | 6 | 7 | 8 | 9 | 10 | 1 | 2 |
| Liquid stability | ◎ | ◎ | ◎ | ◎ | ◎ | ○ | ○ | Δ | Δ | Δ | ○ | ◎ |
| Initial releasability | ◎ | ◎ | ◎ | ◎ | ◎ | ◎ | ◎ | ◎ | ◎ | ◎ | Δ | x |
| Sustained releasability | ◎ | ○ | ◎ | ○ | ◎ | ◎ | ○ | ◎ | ◎ | ○ | x | x |

TABLE 4

| | EXAMPLE | | | | | | | | COMPARATIVE EXAMPLE | |
|---|---|---|---|---|---|---|---|---|---|---|
| | A | B | C | D | E | F | G | H | 1 | 2 |
| Liquid stability | ◎ | ◎ | ◎ | ◎ | ◎ | ◎ | ◎ | ◎ | ◎ | ◎ |
| Initial releasability | ◎ | ◎ | ◎ | ◎ | ◎ | ◎ | ◎ | ◎ | x | x |
| Sustained releasability | ◎ | ○ | ◎ | ◎ | ◎ | ◎ | ◎ | ○ | x | x |

We claim:

1. A stock solution for preparing an oil-in-water release agent for green sand mold forming, which consists essentially of a hydrocarbon oil as a main lubrication component; a nonionic surfactant as a dispersant; an anionic surfactant and not less than 1 wt % of an amine selected from the group consisting of morpholine, piperidine, piperazine, pyrrolidine, pyrrole, imidazole, diethylamine and benzylamine, as wettability improving agents; and a fatty acid having 8 to 20 carbon atoms as a release agent assistant.

2. A stock solution according to claim 1, wherein said fatty acid is present in an amount of from 2 to 40 parts fatty acid weight of the hydrocarbon oil.

3. A release agent for green sand mold forming, which comprises an oil-in-water emulsion consisting essentially of water; a hydrocarbon oil as a main lubrication component; a nonionic surfactant as a release agent; an anionic surfactant and not less than 1 wt % of an amine selected from the group consisting of morpholine, piperidine, piperazine, pyrrolidine, pyrrole, imidazole, diethylamine and benzylamine, as wettability improving agents; and a fatty acid having 8 to 20 carbon atoms as a release agent assistant.

4. A release agent according to claim 3, wherein said fatty acid is present in an amount of from 2 to 40 parts fatty acid per 100 parts by weight of the hydrocarbon oil.

5. A stock solution which on dilution with water forms a release agent for green sand mold forming, which comprises an amine selected from the group consisting of piperidine, piperazine, pyrrolidine, pyrrole, imidazole, diethylamine and benzylamine; 20 to 80 parts of glycol per 100 parts by weight of the amine; and 10 to 50 parts of a fatty acid having 8 to 20 carbon atoms per 100 parts by weight of the amine.

6. A release agent for green sand mold forming, which comprises an aqueous solution comprising an amine selected from the group consisting of piperidine, piperazine, pyrrolidine, pyrrole, imidazole, diethylamine and benzylamine; 20 to 80 parts of glycol per 100 parts by weight of the amine; and 10 to 50 parts of a fatty acid having 8 to 20 carbon atoms per 100 parts by weight of the amine.

* * * * *